United States Patent [19]

Suominen

[11] 4,088,520

[45] May 9, 1978

[54] METHOD OF DENSIFYING NEEDLED NON-WOVEN WEBS

[75] Inventor: Lennart Eino Olavi Suominen, Nakkila, Finland

[73] Assignee: J. W. Suominen OY, Finland

[21] Appl. No.: 698,152

[22] Filed: Jun. 21, 1976

Related U.S. Application Data

[63] Continuation-in-part of Ser. No. 523,117, Nov. 12, 1974, abandoned.

[51] Int. Cl.[2] ..... B32B 5/00

[52] U.S. Cl. ..... 156/73.6; 28/113; 156/148; 428/300

[58] Field of Search ..... 156/62.2, 62.6, 62.8, 156/73.6, 148; 28/72.2 R; 428/300

[56] References Cited

U.S. PATENT DOCUMENTS

| | | | |
|---|---|---|---|
| 1,002,177 | 8/1911 | Reynolds | 28/72.2 R |
| 1,742,338 | 1/1930 | Bettison | 28/72.2 R |
| 2,178,528 | 10/1939 | Dalmau | 156/73.6 |
| 2,181,043 | 11/1939 | Boeddinghaus | 28/72.2 R |
| 2,437,689 | 3/1948 | Francis | 28/72.2 R |
| 3,627,602 | 12/1971 | Van Dijk | 156/73.6 |
| 3,630,808 | 12/1971 | Yasui | 156/73.6 |

FOREIGN PATENT DOCUMENTS

| | | | |
|---|---|---|---|
| 982,801 | 2/1965 | United Kingdom | 28/72.2 R |

*Primary Examiner*—Caleb Weston

*Attorney, Agent, or Firm*—Hill, Gross, Simpson, Van Santen, Steadman, Chiara & Simpson

[57] ABSTRACT

Preparation of a non-woven web of fibrous material so as to obtain a product having considerably better mechanical characteristics than the "breathable" non-woven fabrics of the prior art, without any substantial loss of its softness, drape or porosity characteristics. A starting needle punched non-woven web consisting substantially of thermoplastic synthetic fibers is subjected to pulsating sharp blow mechanical pressure applied transversely to web surface sufficient to generate heat by inter-fiber friction and deformation work subjected on the fibers to increase the temperature of fibers to soften them and bring the fibers tightly to adhere one with another and lock together because of the non-regular shape of fiber surface and cross section caused by said treatment. Simultaneously the interstices between the fibers are reduced and the web is compacted resulting in a relatively close natural leather-like non-woven fabric. Surface density and smoothness are attained by clubbing of the fiber ends, which tend to project outwardly initially beyond a face of the web, into substantially expanded form.

11 Claims, 4 Drawing Figures

METHOD OF DENSIFYING NEEDLED NON-WOVEN WEBS

RELATED APPLICATION

This application is a continuation-in-part of my earlier filed U.S. application Ser. No. 523,117 filed Nov. 12, 1974, now abandoned.

BACKGROUND OF THE INVENTION

A non-woven fabric or fibrous web obtained from a needle loom and constituting a starting material for the practice of this invention will remain comparatively fluffy, even if the fibers comprising such web were absolutely perfectly randomly oriented, as is evident from the fact that, when using 100 percent of synthetic fiber of circular cross section in such a web, the resulting product is a web containing more than 50 percent, by volume of air, for example, according to some measurements, about 53 percent. A comparison of such a prior art web with natural leather, which, depending on the tanning and treatment methods used, may contain from 85 to 96 percent by volume of fibrous material, shows that the prior art non-woven web is quite airy and consequently has modest strength properties. A closer scrutiny of natural leather reveals that the fibers therein are not circular, but are rather of such various random surface configurations that they tightly engage one with another and bond together, principally by the friction therebetween, to form a supple and soft leather. This very observation constitutes the basis of the practice according to the present invention.

BRIEF SUMMARY OF THE INVENTION

Accordingly, in one aspect, this invention relates to a process for preparing a non-woven web of fibrous material from a starting material comprising a needle punched non-woven web of fibrous material such as one made in a needle loom, and comprising partially or exclusively thermoplastic fibrous material. The invention involves the subjection of the starting needle punched web to a pulsating, sharp blow mechanical pressure and release action effect sufficient to raise the temperature of the thermoplastic fibers to their softening temperature, whereby the pulsating mechanical pressure simultaneously reduces the original interstices between the fibers and compacts the fibers, softened at least at their surfaces, to a more intimate contact with each other. This starting needle punched web can optionally be subjected to preheating by a heat conduction treatment for raising the fiber temperature to a level below the melting and also the softening temperature of the fibers to permit a quicker further raise of temperature to a level where at least the surface layer of the fibers soften because of such a pulsating mechanical pressure effect to the thus possibly preheated web. Deformation of the fiber surfaces results, and because of the substantially increased interfiber frictional bond brought about by such treatment, the fibers become locked one to another.

In another aspect, the invention relates to the product non-woven felted, needled, compacted web produced in accord with the teachings of this invention. Such a product typically has improved strength properties compared to a starting web and may be compared to a natural leather.

Other and further aspects, aims, objects, advantages, features, and the like will be apparent to those skilled in the art from the present specification with the appended drawings.

DETAILED DESCRIPTION

Figure 1:
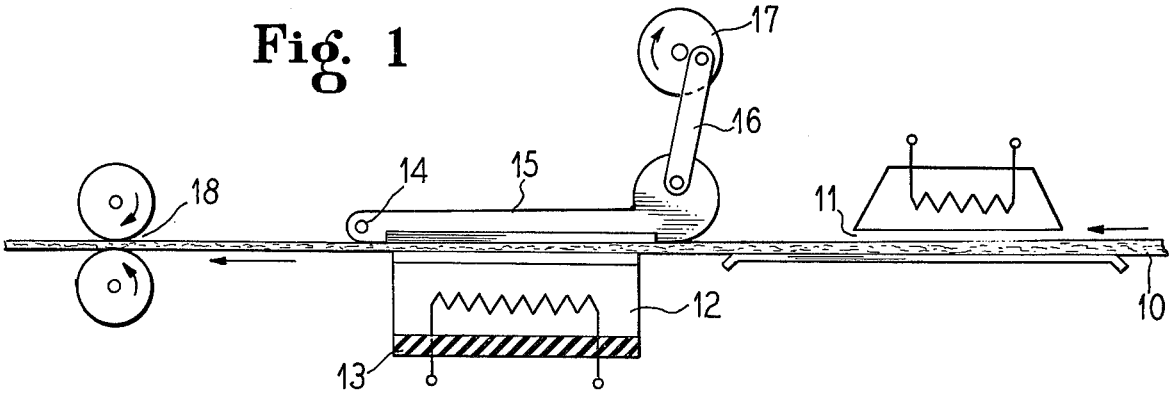
FIG. 1 shows schematically an embodiment of the present invention employing an impact or hammering arrangement.

According to this invention, all or a portion of a non-woven, needle punched web of fibrous material incorporating thermoplastic fibers is subjected to a pulsating, sharp blow mechanical treatment by and during which the web is heated and the thermoplastic fibers therein are passed and deformed against the adjacent surfaces of other fibers without, however, adhering to the same, whereby, after cooling of the so-treated fibrous web, the resulting web, because of interfiber friction, will not revert to the density of the starting web but rather constituted a felted product considerably resembling natural leather.

A needle punched starting web may consist exclusively of synthetic thermoplastic fibers, or may have mixed therewith other materials, such as natural fibers, in various proportions, for instance up to a weight ratio of about 50:50 of synthetic thermoplastic fibers to natural fibers. Suitable thermoplastic fibers include, for examples, those derived from such organic polymers as polypropylene, polyester, polyvinyl alcohol, polyamide, polyacrylonitrile, polyvinyl chloride, and the like. Inorganic fibers of glass and the like, particularly those which soften in temperature ranges comparable to those over which organic polymeric fibers soften, can also be included in the group of suitable thermoplastic fibers. It will be appreciated that suitable thermoplastic fibers also may include conventional organic polymeric heat shrinkable fibers. Typically a starting web contains more than 50% by volume of air.

In the practice of the present invention, use can be made of any suitable conventional machines or apparatus, as will be self-evident for any person skilled in the art from the present teachings of this invention which will produce the desired pulsating mechanical effect desired and described herein.

In continuous commercial scale production, a semi-finished product obtained from a needle loom may be passed, possibly for a required heating as may be utilized in a non-woven, needle punched web conventional manufacture, or optionally for preheating to a desired temperature, preceding a pulsating mechanical treatment in accord with this invention. Suitable heating means include heating ovens, infrared heating fields, and the like. Thereafter, the starting web of fibrous material is passed into a pulsating mechanical treatment apparatus forcing the fibers into intimate engagement with each other. It is, however, to be appreciated that during such a treatment, the fibers must not bond or adhere to each other, because this would result in a comparatively stiff and hard final product which is not desired by this invention. When required or desirable, a suitable finishing agent may optionally be used at the fiber surfaces to prevent adhesion.

The elevated temperature to which a web is heated during such a treatment thus must not be so great as to melt the thermoplastic fibrous material and/or to agglomerate the fibers comprising a web. The heating must be controlled so as to maintain a temperature below the melting point of the thermoplastic fibrous material, but must be maintained and sustained for a time and at a temperature sufficient to cause at least a surface layer of the fibers to soften and to be almost, or to be even fully plastic, during the pulsating mechanical treatment, according to this invention. The optimum temperature and temperature exposure time in any given pulsating mechanical treatment operation is somewhat variable owing not only to the particular type and characteristics of the particular synthetic thermoplastic fibers involved, but also to the particular equipment and processing considerations involved, as those skilled in the art will readily appreciate, so that no particular temperature, for example, can be specified herein as being optimum for all treatment situations within the spirit and scope of this invention.

The pulsating mechanical treatment can be achieved by means of mechanical impacts and hammerings, i.e., sharp blows against web faces. During such treatment, the web can continuously pass through the hammering zone. The web being treated can, if desired, travel between supporting belts, preferably steel belts, such as a paper web travels between the drying felts of a paper making machine.

The thermoplastic fibers in a web being treated in accord with this invention can be heated as indicated above by repeated mechanical impacts only using sufficient impact pressures applied for sufficient periods of time, thereby to generate internal heat between web fibers because of such factors as inter-fiber friction deformation work subjected onto the fibers, and the like. However, to reduce the quantity of such mechanical energy needed, and also the duration of such mechanical treatment, a given web being treated can be heated to some chosen elevated temperature which is not above the melting but below the softening point of the thermoplastic fibers present, as explained, either before, or simultaneously during, mechanical treatment thereof.

Thus, according to one embodiment of the invention, a starting web is preheated to just such an extent that the desired softening of thermoplastic fibers in such web almost commences (e.g. preferably to a temperature of from about 80° to 100° C, the thermoplastic synthetic fibers being so chosen so as to soften as desired above this temperature range) whereafter such preheated web is subjected to a mechanical impact or hammering treatment which causes the fibrous material comprising the web undergoing treatment to become more close or dense, while its temperature, as a result of the mechanical treatment, is raised further, for example, by from about 25° to 50° C more. The fibers thus reach a softening temperature necessary for the required plasticity. Mechanical energy is thus converted to heat which brings to the fibrous material the additional amount of calories necessary for the desired temperature rise. Such a combination of applied heat and applied mechanical energy is advantageous from the point of view of heat economy and in addition, the fibers as a result of the impact effect, become as if riveted to each other when so compacted.

This mechanical treatment with web at such an elevated temperature compacts the fibers of the web, reduces the interstices therebetween, and causes adherence between the subsequently cooled fibers due to the remaining non-regular shape of the fiber surfaces and cross sections. The term "adherence" is used herein to indicate a rather firm gripping action between fibers exists without having them fused together, such as would result if the thermoplastic fibers melted during such mechanical treatment. In any event, there is no intent to be bound by theory herein.

A product obtained by the practice of this invention is dense, its content of air being characteristically down to below about 20 percent by volume by measurement, and it possesses improved mechanical strength (compared to a starting web) to a desirable extent in every direction. The product can successfully be used for purposes for which it has heretofore been necessary to use sheet materials, such as leather, sturdy woven fabric, strong felt, or the like, while it, like all such prior art materials, is permeable to gases, such as air, or the like. A product of this invention is thus "breathable, " which is a requirement in many applications.

The density or closeness of the resulting product is apparent also by observation of its surface, which is so smooth that it can be finished by conventional surface coloring techniques. It may be mentioned that fiber end portions which tend to project outwardly initially beyond a face of a starting web characteristically tend to become during the processing treatment in accord with this invention clubbed flat, in a manner of speaking, so that such ends at the web surface become somewhat expanded and resemble the end of a club, or the head of a rivet, from the effects of the heat and of the hammering. This, in turn, brings about the indicated great surface closeness and smoothness.

The impact or hammering frequency is conveniently and preferably in the range of from about 200 to 1500 per minute, though other frequencies can be employed. Such an impacting can be brought about either by any convenient means, such as by means of a hammer plate mounted on a shaft extending transversely to the travel direction of the web being treated wherein one end, suitably the upstream end of such plate, is connected by means of a connecting rod or the like, to a crank shaft, wheel or the like. The stroke length can range, for instance, from about 5 to 10 mm or the like, depending on the product being produced. Below this impact plate, there is provided an optionally heated and/or vibrating spring mounted support anvil. The web being heated can travel over or between an optional preheating station located between the hammer plate and the support anvil. After impact treatment, a product web is wound or subjected to a repeated impact treatment. The impact can obviously be brought about by various other art known means, for instance, by means of pneumatic devices.

It should be further appreciated that the above discussed mechanical treatments can of course be repeated once or several times, as desired for a given web, in order to obtain a desired product.

Typically and preferably, the pulsating mechanical pressure has an application force in the range of from about 100 to 500 kilograms per square centimeter of treated web area.

Referring to FIG. 1, a needle punched starting web 10 is passed (see arrows indicating travel path) through an optional heating zone 11 onto a vibrating support 12 which preferably is mounted in a stiffly sprung manner, such as on a vibration absorbing rubber cushion 13. This support 12 can optionally be heated to slightly below the softening temperature of the fibers in web 10. Above the support 12, an impact plate 15 having a width equal to that of the web 10 is positioned. Plate 15 is connected to a horizontal shaft 14 so that the plate 15 is adapted to receive a reciprocating vertical movement from a rotatably driven crank wheel 17 through a connecting rod 16. The fibrous material web 10 travels between the support 12 and the impact plate 15 driven by a pair of feed rolls 18 in the analogous manner as a conventional needle punched web may be repeatedly needled.

Figure 2:
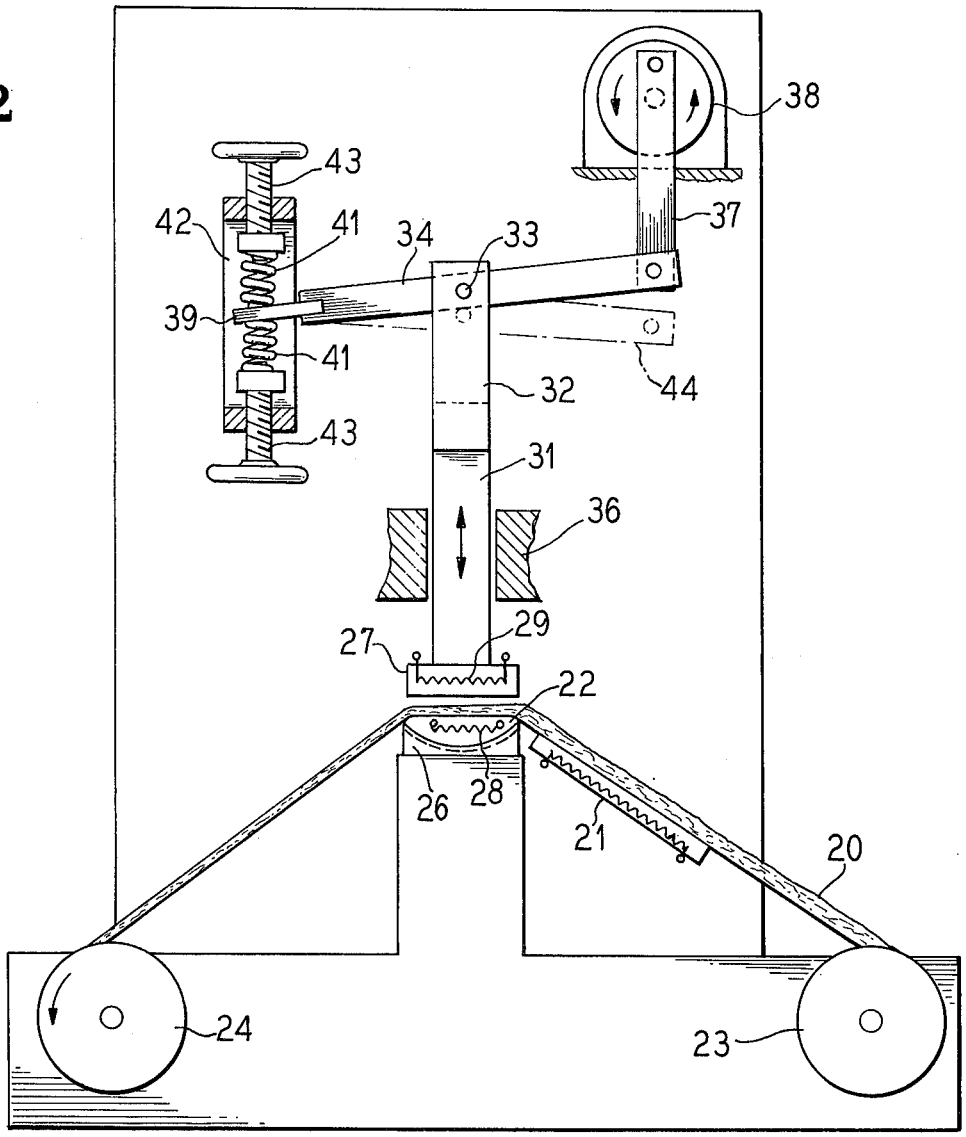
FIG. 2 shows schematically an alternative embodiment employing such arrangement.

Referring to FIG. 2, a web 20 being treated is passed from a supply roll 23 through an optional preheating zone 21 over an anvil 22 and to a take up roll 24. Conventional drive means (not shown) is provided for advance and coiling of web 20. Preheating zone 21 is here provided with an electrically resistance-heated coiled wire (shown diagramatically). Anvil 22 has a flattened upper surface and a generally cylindrically curved lower surface which rests in mating engagement with a seat 26, so that anvil 22 can "float" and move responsively to web 20 movements and impacts thereagainst of hammer head 27. The respective widths of anvil 22 and hammer head 27 are such as to be at least equal to the width of web 20.

An optional heating zone in the impact region of anvil 22 and hammer head 27 is provided by mounting internally in each of anvil 22 and hammer head 27 respective electrically resistance heated coiled wires 28 and 29, respectively. Thus, if desired, web 20 can be heated by the preheating zone 21 and by the heating zone in the impact region, as described, if desired. It is noted with particularity that such preheating and heating is not necessary to the practice of this invention. If such zones are utilized, they are employable separately or in combination with one another. The temperature generated by such zones is controlled by conventional temperature regulation means (not shown); the temperature of a web 20 is not permitted to reach the softening temperature of thermoplastic fibers incorporated into web 20.

Hammer head or plate 27 is secured on its back face to a reciprocatorily moveable drive shaft 31 which terminably connects at its upper end to a yoke 32. A connecting rod 33 mounted between the opposed upper ends of yoke 32 extends through a mid portion of fulcrum 34. A guide plate 36 for shaft 31 is provided. A connecting rod 37 interconnects functionally the swinging end of fulcrum 34 to revolvably driven crank wheel 38. A holding plate 39 extends longitudinally outwardly from the pivoting end of fulcrum 34 to a mounted, clamped position between a pair of opposed compressed coil springs 41.

A U-shaped bracket 42 threadably mounts in opposed relationship through terminal regions of the arms thereof a pair of adjusting screws 43 which are adapted to maintain an adjustable tensioning of springs 41 upon opposing faces of plate 39. Pressure of springs 41 upon plate 39 regulates the force exerted by hammer plate 27 upon web 20 and also provides a floating pivot point for fulcrum 34. The assembly of bracket 42, screws 43 and springs 41 thus provides a resilient cushion which is desirable because seat 26 is rigid. Adjustment of screws 43 regulates both the minimum space between hammer head 27 and anvil 22 over which web 22 travels and also the impact pressure exerted between head 27 and anvil 22 upon a web 20 during operation of such apparatus. Phantom lines 44 illustrate a lower position which fulcrum 34 can occupy during apparatus operation.

Figure 3:
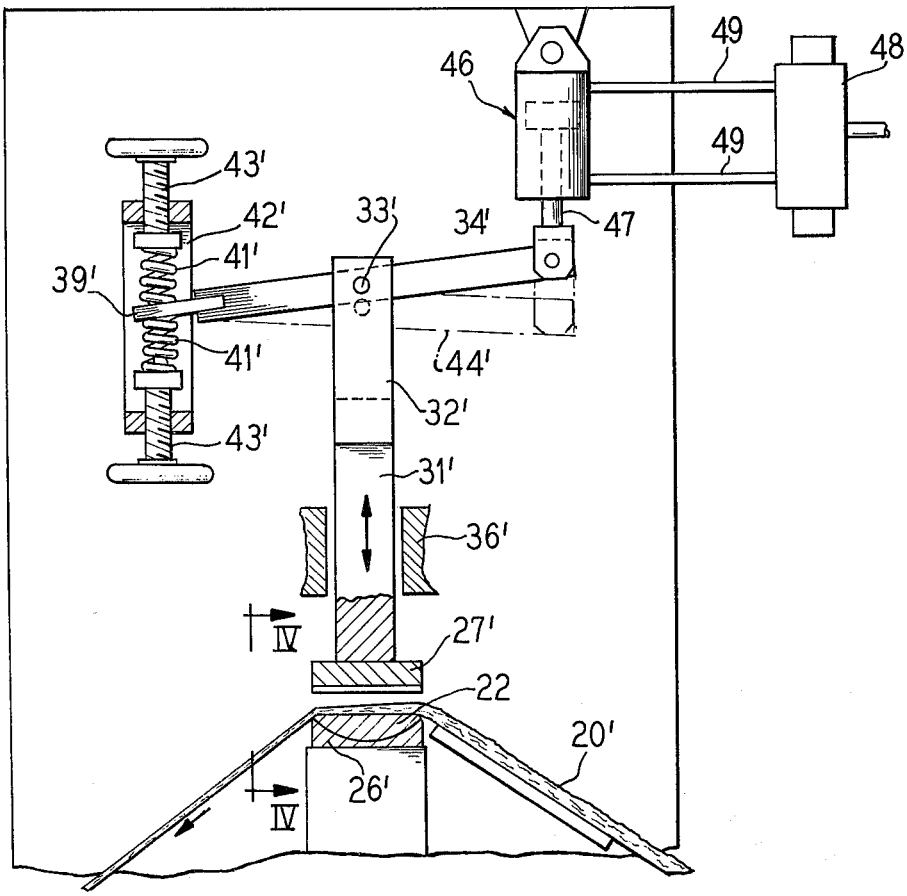
FIG. 3 is a detail view of an alternative anvil drive assembly for the embodiment shown in FIG. 2.

Referring to FIG. 3, there is seen an alternative apparatus similar to that in FIG. 2, except that here the connecting rod 37 and crank wheel 38 are replaced by a double acting pneumatic cylinder assembly 46 whose piston rod 47 functionally joins with fulcrum 34'. Control valve 48 interconnects functionally with cylinder 46 via tubing 49. Valve 48 is employed to control reciprocal movements of shaft 31' by regulating pneumatic fluid charging rates, etc., to cylinder 46 as those skilled in the art will readily appreciate. Components in the apparatus of FIG. 3 which are like corresponding components in the apparatus of FIG. 2 are similarly numbered but with the addition of prime marks thereto. Observe that the FIG. 3 apparatus employs no heating means.

Figure 4:
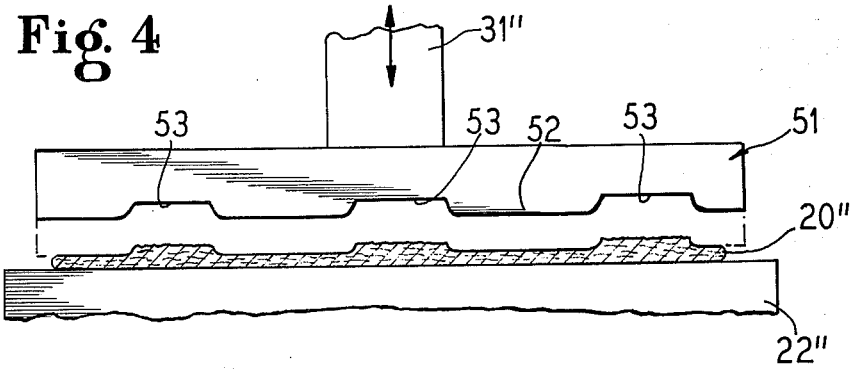
FIG. 4 is a detail view of an anvil assembly for the embodiment shown in FIG. 2.

Referring to FIG. 4, there is seen an alternative apparatus similar to that in FIG. 2 except that here drive shaft 31" is provided with a hammer head 51 having defined across the front face 52 thereof and extending in the direction of travel of web 20" a set of three channels 53. Channels 53 are profiled so as to bring about a desired pattern in the surface of a product web treated in accordance with the present invention, the pattern here being produced being in the nature of stripes. The stripes may be laterally spaced from one another by a discrete distance, for example, from 6 to 8 or 10 mm. Components in the apparatus of FIG. 3 which are like corresponding components in the apparatus of FIG. 2 are similarly numbered but with the addition of double prime marks thereto.

A starting needle punched web as obtained from the needle loom may, when desired, thus be treated only at selected areas of the same. In this manner, even a fairly thick floor carpet may be given the softness and springiness necessary for it, immediately after application, to adjust itself to the floor and stay in place even without glueing. Between these dense stripes, there thus are zones of the material web which are in the state the web was in when it came out from the needle loom.

It will be appreciated that the product obtained by the process of the invention is softenable, for instance, lubricatable or impregnatable, and otherwise dinishable in the same manner as natural leather, so that, with respect to softness and porosity, it may be made comparable with, for instance, nappa (a very soft grain) leather.

The impacting or hammering of a web as taught herein produces a change of pressure with time in relation to a web comparable to spaced squares or rectangles in a graph where pressure is shown as abscissae and time as ordinates which is in sharp and non equivalent contrast to less sharply defined changes of pressure with respect to time, such as is characteristic of pressures exerted in a nip region between rolls, where, in relation to a web, the changes are comparable to a sine curve in a comparable graph. It is only by the teachings of the present invention that one can achieve the class of "concentrated" blows needed to reach the sort of fiber deformation described earlier achieved in product webs of this invention, such fiber deformation being believed to be an important factor in obtaining the properties characteristically associated with product webs of this invention.

EMBODIMENTS

The present invention is further illustrated by reference to the following examples. Those skilled in the art will appreciate that other and further embodiments are obvious and within the spirit and scope of this invention from the teachings of these present examples taken with the accompanying specification.

When the present process was compared with the known prior art needling-shrinking process, it was found that the density of the non-woven product web was generally increased about 2.5 times and the tensile strength from about 4 to 5 times. These trials were carried out making product webs of different thicknesses.

EXAMPLE 1

Apparatus as shown in FIG. 2 is constructed wherein the head 27 has a width of 15 centimeters in the direction of movement of web 20. Web speed is adjusted to 1.5 meters per minute. At a frequency of 900 blows per minute, each cross section of web receives 90 blows in 6 seconds (i.e., 15 blows per second). Each blow has a pressure of 200 kilograms per square centimeter.

In the following examples, some numerical values obtained when testing a product resulting from the practice of this invention are provided when using apparatus as described above in relation to FIGS. 1 or 2.

EXAMPLE 2

The raw material used was polyester heat shrinkable fiber of 1.5 denier and 50 mm fiber length. In a needle loom, this fiber was converted to a twice-needle punched web weighing 280 grams per square meter. Thereafter, in two successive heat with impact treatments, this starting web was hammered to a thickness of 0.4 mm. The tensile strength values of this non-woven starting fabric product after the conventional heat treatment but before processing according to the invention were as follows: In the transverse direction 42 kg/cm$^2$, and in the longitudinal direction, 71 kg/cm$^2$. After processing according to this invention, these values were respectively, 124 kg/cm$^2$ and 250 kg/cm$^2$.

EXAMPLE 3

The starting web of Example 1 is similarly processed as in Example 1 but so as to produce a product of 0.8 mm thickness. The strength values obtained were 174 kg/cm$^2$ and 289 kg/cm$^2$, respectively. The density of the product was further increased by the process to a specific gravity value of 1.17 (the specific gravity of the fiber itself was 1.38) while the same product when shrunk by means of hot water reached a specific gravity value of only 0.48, which indicates that the density obtained by the process of the invention was about 2.5 times that of the conventionally prepared product (the starting web). For the sake of comparison, it may be mentioned that the tensile strength of good chromium salt tanned leather is from 200 to 350 kg/cm$^2$, and, as an average with respect to grain split leather, values ranging from 100 to 150 kg/cm$^1$ are often seen.

I claim:

1. A process for making a non-woven needle punched web of thermoplastic fiber material including the step of:

subjecting the entire thickness of a non-woven needle punched web comprised of thermoplastic fibrous material to repeated sharp blows effecting compressing and release pressure of a sufficient magnitude and for a sufficient duration to generate internal heat between fibers;

and thereby increasing the internal temperature and softening said fibrous material and reducing the internal original interstices between said fibrous material and compacting said fibers of the fibrous material into a more intimate locked contact with each other and causing adherence therebetween and maintaining a compact web condition.

2. A process according to claim 1, including clubbing fiber ends, which tend to project outwardly initially beyond a face of the web, into substantially expanded form and thereby effecting surface density and smoothness.

3. In an improved process for making a non-woven needle punched web comprised of at least 50 weight percent thermoplastic synthetic fibrous material and said web containing initially more than 50% by volume of air, the steps of:

subjecting a non-woven needle punched web of thermoplastic fibrous material to a transversely applied pulsating sharp blow mechanical pressure sufficient to raise the temperature of the thermoplastic fibers in said web to their softening temperature at least on their surfaces;

and by said pulsating sharp blow mechanical pressure reducing the original interstices between said fibers, and compacting said fibers to an extent such that said mechanically softened fibers adhere to one another.

4. The process of claim 3 wherein said web is preheated to a temperature below the softening temperature of said thermoplastic fibers.

5. The process of claim 3 wherein said subjecting is sufficient to produce a product web having an air content below about 20% by volume.

6. The process of claim 3 wherein said pulsating mechanical pressure has a pulsation frequency in the range of from about 200 to 1500 pulsations per minute.

7. The process of claim 3 wherein said pulsating mechanical pressure has an amplitude of from about 5 to 10 mm.

8. The process of claim 3 wherein said pulsating mechanical pressure has an application force in the range from about 100 to 500 kilograms per square centimeter.

9. The process of claim 3 wherein said web is supported during said subjecting.

10. The process of claim 3 wherein said fibers are comprised of polyester.

11. A process according to claim 3, including clubbing fiber ends, which tend to project outwardly initially beyond a face of the web, into substantially expanded form and thereby effecting surface density and smoothness.

* * * * *